United States Patent [19]

Miller et al.

[11] Patent Number: 4,577,366

[45] Date of Patent: Mar. 25, 1986

[54] VACUUM CLEANER NOZZLE HAVING ROTATING BRUSH

[75] Inventors: Jonathan Miller, Haworth, N.J.; Robert C. Berfield, Jersey Shore; Robert L. Crevling, Jr., Williamsport, both of Pa.

[73] Assignee: Shop-Vac Corporation, Williamsport, Pa.

[21] Appl. No.: 620,149

[22] Filed: Jun. 13, 1984

[51] Int. Cl.[4] ..... A47L 9/04

[52] U.S. Cl. ..... 15/388; 15/41 R; 15/415 R

[58] Field of Search ..... 15/41 A, 41 R, 388, 15/415 R

[56] References Cited

U.S. PATENT DOCUMENTS

| | | | |
|---|---|---|---|
| 1,204,718 | 11/1916 | Putten | 15/388 |
| 2,642,617 | 6/1953 | Lilly | 15/388 |
| 3,268,936 | 8/1966 | Fukuba | 15/41 R |
| 3,871,051 | 3/1975 | Collier | 15/321 |
| 4,498,207 | 2/1985 | Rosendall | 15/41 R |

FOREIGN PATENT DOCUMENTS

| | | | |
|---|---|---|---|
| 59537 | 2/1954 | France | 15/388 |
| 588124 | 5/1947 | United Kingdom | 15/388 |
| 2077093 | 12/1981 | United Kingdom | 15/415 R |

*Primary Examiner*—Chris K. Moore

*Attorney, Agent, or Firm*—Ostrolenk, Faber, Gerb & Soffen

[57] ABSTRACT

A nozzle assembly for a vacuum cleaner is provided with floor engaging wheels that are frictionally engaged with and rotate additional wheels that are secured to the ends of a brush in a manner such that rotation of the additional wheels causes the brush to rotate. As the vacuum nozzle assembly is moved back and forth across a floor that requires cleaning, the wheels engaging the floor are caused to rotate thereby rotating the brush in the opposite direction. The latter agitates the carpet or other floor covering to loosen and direct dirt particles toward the inlet slot of the vacuum cleaner nozzle.

7 Claims, 8 Drawing Figures

VACUUM CLEANER NOZZLE HAVING ROTATING BRUSH

BACKGROUND OF THE INVENTION

This invention relates to vacuum cleaners in general and in particular relates to a vacuum cleaner nozzle assembly that includes a non-power driven rotatable brush.

Conventional vacuum cleaners and vacuum cleaner nozzles that use brushes are of two basic types. One type utilizes a fixed or spring-mounted brush that agitates and scrapes carpets and hard surfaces to loosen dirt particles and the second type utilizes a motor-driven reel type rotary brush for the same purpose. The latter is not usually recommended for hard floors.

In the prior art, some vacuum cleaners and vacuum cleaner nozzles that were provided with rotating brushes utilized a single motor to rotate the brush and also operate the suction producing fan. In some other prior art, vacuum cleaners and vacuum cleaner nozzles of this type, one motor was provided to produce suction and a separate motor was provided to rotate the brush.

These prior art constructions have been costly, have resulted in apparatus of excessive weight, and the electrically rotated brush has created safety problems. A typical prior art construction for a vacuum having a powerdriven rotatable brush is disclosed in U.S. Pat. No. 3,871,051 issued Mar. 18, 1975 to S. W. Collier for a Machine for Cleaning Carpets and the Like.

BRIEF DESCRIPTION OF THE PRESENT INVENTION

In accordance with the instant invention, the foregoing problems of the prior art are avoided by providing a vacuum cleaner nozzle with a non-power driven rotatable brush that works well on carpets and hard surfaces. This is accomplished by constructing a nozzle assembly having floor engaging wheels that are rotated by the user as he moves the nozzle assembly back and forth across the floor. These wheels frictionally engage and thereby drive other wheels that are keyed to a reel type brush so that as these other wheels rotate the brush also rotates. The assembly includes a floor plate having an inlet slot that is positioned immediately forward of the brush so that as the assembly moves forward the brush rotates to loosen dirt particles and drive same toward the inlet slot. Similarly, as the nozzle assembly is moved to the rear, the brush rotates in the reverse direction and dirt loosened thereby is directed by a partition of the head plate toward the inlet slot.

Accordingly, the primary object of the instant invention is to provide a novel, improved vacuum cleaner nozzle having a rotating brush that works well on both carpets and hard surfaces.

Another object is to provide a vacuum cleaner nozzle of this type that includes a rotating brush yet is inexpensive, relatively light in weight and is safe to operate.

Still another object is to provide a vacuum cleaner nozzle of this type having a novel assembly with a non-power driven rotatable brush.

BRIEF DESCRIPTION OF THE DRAWINGS

These objects as well as other objects of this invention shall become readily apparent after reading the following description of the accompanying drawings in which.

DETAILED DESCRIPTION OF THE DRAWINGS

Figure 1:
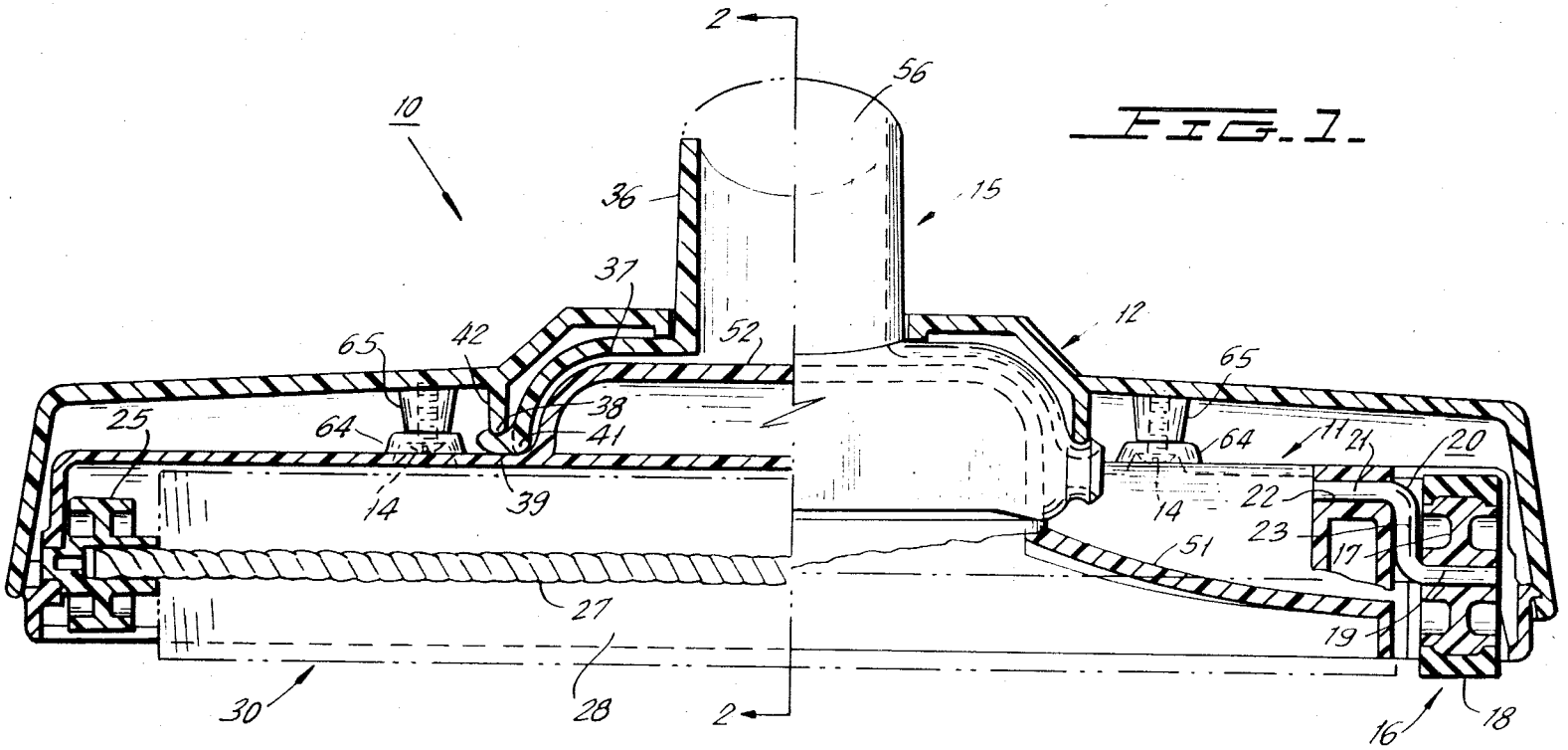
FIG. 1 is a partially sectioned front elevation of a nozzle assembly constructed in accordance with teachings of the instant invention.

Now referring to the drawing figures. Nozzle assembly 10 of FIGS. 1 and 2 includes three main molded plastic elements, namely, floor plate 11, cover 12 secured to floor plate 11 by screws 14, 14, and swivel fitting 15 which, as will hereinafter be seen, is retained in operative position by being captured between portions of floor plate 11 and cover 12. Floor plate 11 is elongated in the direction perpendicular to the front to back direction in which nozzle assembly 10 is moved along the floor on its pair of wheels 16, 16. Each of the latter consists of molded plastic hub 17 surrounded by rubber like ring or tire 18. Each wheel is rotatably supported on one end 19 of formed wire axle 20 whose other end 21 extends into bearing aperture 22 in floor plate 11.

Figure 2:
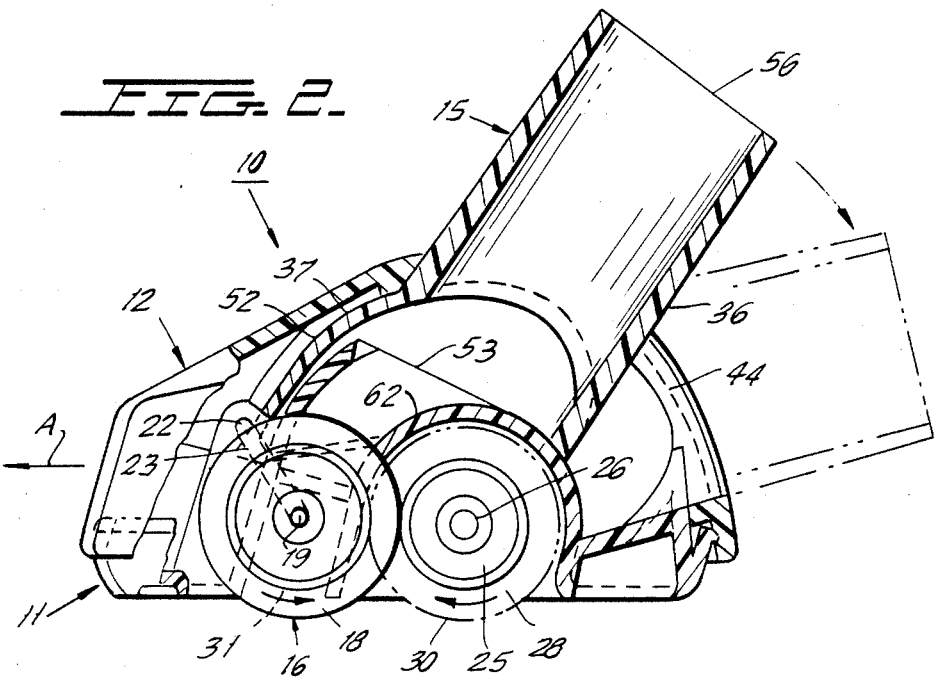
FIG. 2 is a cross section taken through line 2—2 of FIG. 1 looking in the direction of arrows 2—2.
Figure 3:
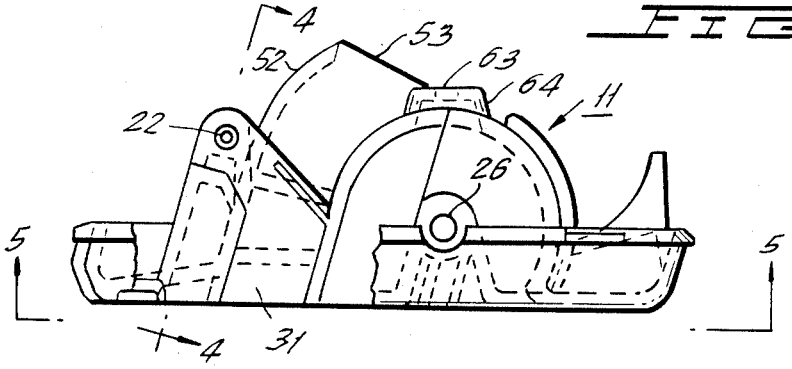
FIG. 3 is a side elevation of the floor plate.
Figure 4:
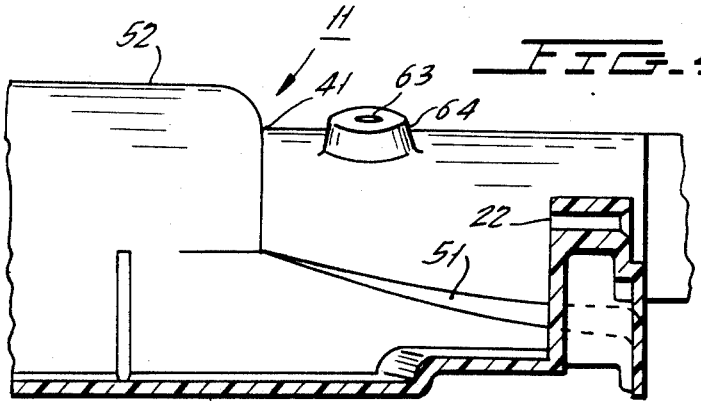
FIG. 4 is a fragmentary cross section of the floor plate taken through line 4—4 of FIG. 3 looking in the direction of arrows 4—4.
Figure 5:
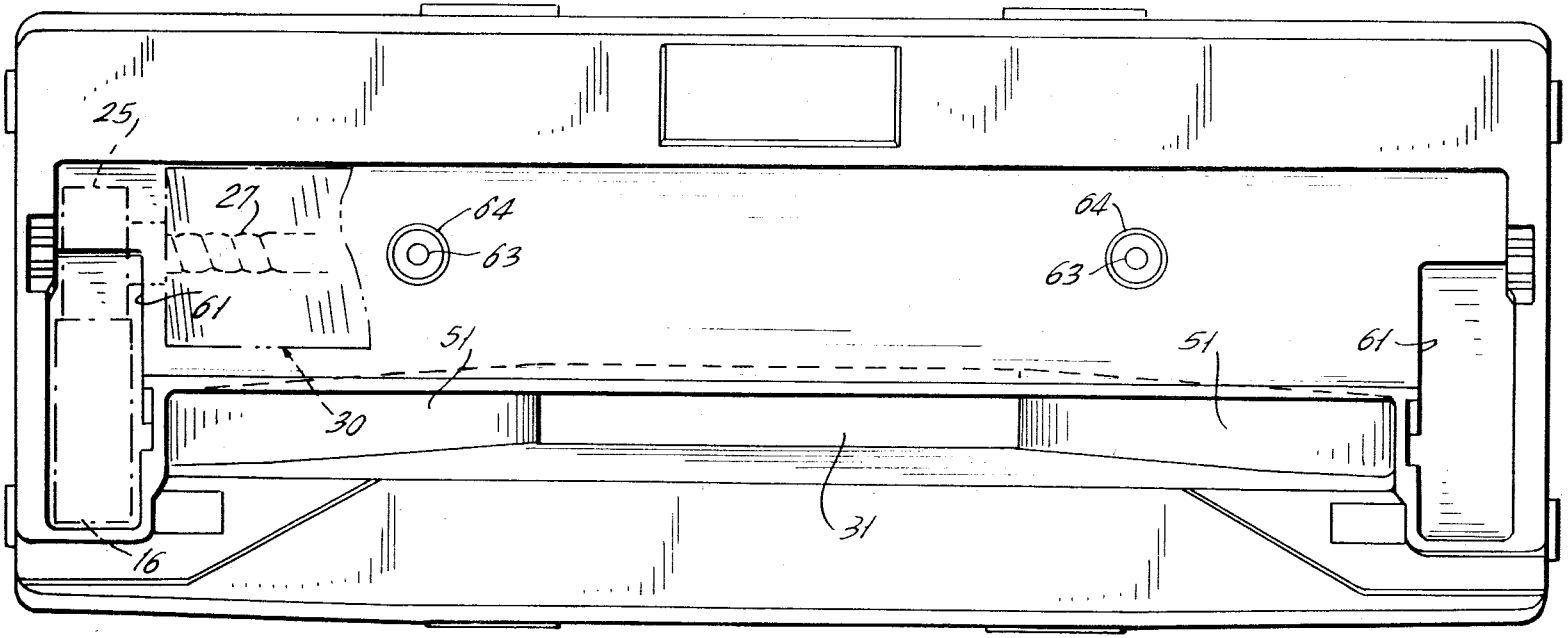
FIG. 5 is a bottom view of the floor plate looking in the direction of arrows 5—5 of FIG. 3.
Figure 6:
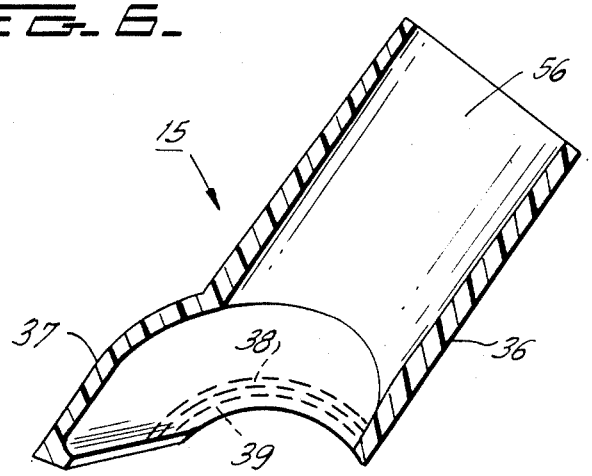
FIG. 6 is a cross section of the swivel fitting taken through line 2—2 of FIG. 1 looking in the direction of arrows 2—2.
Figure 7:
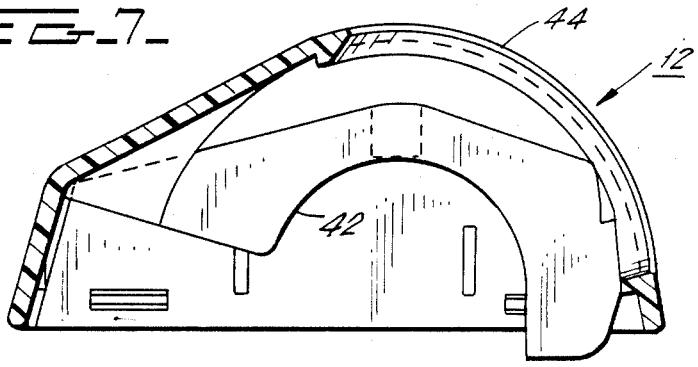
FIG. 7 is a cross section of the cover taken through line 2—2 of FIG. 1 looking in the direction of arrows 2—2.
Figure 8:
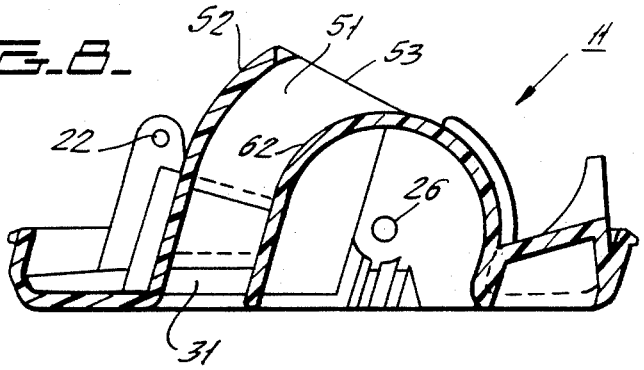
FIG. 8 is a cross section of the floor plate taken through line 2—2 of FIG. 1 looking in the direction of arrows 2—2.

As seen in FIG. 2 connecting portion 23 at the mid-region of axle 20 is rearwardly inclined in a downward direction so that as nozzle assembly 10 is moved in the forward direction indicated by arrow A in FIG. 2, tire 18 is forced against driven wheel 25 in frictional engagement with the knurled outer surface thereof so that the rotation of wheel 16 in a counter-clockwise direction rotates wheel 25 clockwise with respect to its axis defined by bearing aperture 26 in floor plate 11. Since the diameter of wheel 25 is less than the diameter of tire 18, wheel 25 will rotate faster than wheel 16.

An individual wheel 25 is secured to opposite ends of reel type brush 30. That is, an individual wheel 25 is forced fitted on each end of wire spine 29 for brush 30. Bristles 28 extend radially from spine 29. With brush 30 rotating clockwise, bristles 28 thereof drive dirt forward toward elongated inlet slot 31 at the bottom of floor plate 11. This dirt is drawn into inlet 31 by the low pressure or vacuum applied to nozzle assembly 10 at its outlet, the upper end of swivel fitting 15. The latter is a hollow member having cylindrical neck portion 36 that extends upward from the center of horizontally extending bearing portion 37. The outboard ends of bearing portion 37 are formed with arcuate seats 38, 39. Lower seat 39 rests against arcuate bearing formation 41 of floor plate 11 and upper seat 38 receives arcuate bearing formation 42 of cover 12 so that swivel fitting 15 is retained in its operative position through the cooperation of floor plate 11 and cover 12. Swivel fitting 15 is pivotable about a horizontal axis to permit neck 36 to move forward and rearward, in a vertical plane. This movement is limited by the end boundaries of slot 44 in cover 12.

The lower or entrance end of slot 31 extends for nearly the full width of floor plate 11, but tapers gradually in an upward direction to a much smaller width as defined by sloping partitions 51 of floor plate 11. At their inboard ends, partitions 51 are connected by upwardly bulging hood 52. The latter is disposed within bearing formation 37 and is open at its upper end to provide aperture 53. The latter permits communication between the interior of swivel fitting neck 36 and slot entrance 31 so that with an elongated hollow handle (not shown) connected to a suction source removably secured to neck 36, in a manner well known to the art, dirt at entrance 31 will be drawn through nozzle assembly 10 and exit therefrom through the open upper end 56 of neck 36.

Floor plate 11 also includes partition 62 which is generally arcuate in cross section and provides a hood that covers the upper portion of brush 30. Clearance apertures 63, 63 are provided in upward protrusions 64, 64 of floor plate 11 for the passage of screws 14, 14 that are received by apertures in internal embossments 65, 65 of cover 12. Internal formations of floor plate 11 also form individual recesses 61, 61 for wheels 16, 16. To minimize stresses between moving elements, floor engaging wheels 16, 16 are independently and floatingly mounted. That is, the position of each wheel 16 relative to its cooperating driven wheel 25 does not depend upon the relative position of the other wheel 16 with respect to its driven wheel 25. This condition is enhanced by having axle end 21 freely rotatable in bearing aperture 22. Thus, as nozzle assembly 10 is moved forward in the direction indicated by arrow A, not only does drive wheel 16 rotate counter-clockwise, but it also pivots bodily about axle end 21 as a center to assure that wheel 16 engages wheel 25.

As nozzle assembly 10 is moved rearward, drive wheel 16 will usually rotate driven wheel 25 in a counterclockwise direction. Under these circumstances some dirt particles loosened by brush 30 will be carried by the latter along the inner surface of partition 62 and then be deposited on the floor adjacent to intake slot 31 while the remaining dirt particles (those that are not moved along the interior surface of partition 62) will fall to the floor and be picked up when they are reached by slot 31.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A nozzle assembly for a vacuum cleaner, said assembly including an inlet, outlet means at which low pressure is applied to said assembly to draw dirt particles through said inlet into and through said nozzle assembly, floor engaging first wheel means driven by movement of said nozzle assembly across a floor, floor engaging rotatably mounted brush means and a second wheel means secured to said brush means for rotation therewith, and frictionally driven by rotation at said first wheel means said brush means, when so driven, brushing dirt particles toward said inlet; said first wheel means rotating at a speed substantially slower than the speed of rotation for the second wheel means; the first and second wheel means rotating in opposite directions on parallel axes;

a floor plate defining said inlet; said outlet means including a hollow swivel fitting pivotably connected to said floor plate and releasably connectable to a hollow handle through which low pressure is applied to said assembly;

said second wheel means being mounted for rotation on a first axis that is fixed with respect to said floor plate; said first wheel means includes first and second wheels rotatably mounted at opposite sides of said floor plate and bodily movable with respect to said floor plate;

a cover secured to said floor plate and having first bearing means that cooperate with second bearing means on said floor plate to pivotably support and retain said swivel fitting;

said swivel fitting including a hollow neck having one end releasably connectable to a hollow handle, said cover including a slot within which said neck moves as said swivel fitting pivots about a swivel axis defined by said first and second bearing means, said neck extending transverse to said swivel axis.

2. A nozzle assembly as set forth in claim 1 in which the swivel fitting includes first and second bearing sections spaced along said swivel axis and disposed outboard of the neck on opposite sides thereof, each of said first and second bearing means including laterally spaced first and second portions operatively engaged with the respective first and second bearing sections.

3. A nozzle assembly as set forth in claim 2 in which the second wheel means is mounted for rotation on a first axis that is fixed with respect to said floor plate and the first wheel means includes first and second wheels rotatably mounted on individual axles disposed at opposite sides of said floor plate and that are bodily movable with respect to said floor plate.

4. A nozzle assembly as set forth in claim 1 in which the first and second wheel means rotate in opposite directions on parallel axes.

5. A nozzle assembly as set forth in claim 1 in which the first wheel means rotates at a speed substantially slower than the speed of rotation for the second wheel means.

6. A nozzle assembly as set forth in claim 5 in which the first and second wheel means rotate in opposite directions on parallel axes.

7. A nozzle assembly as set forth in claim 1, wherein said first and second wheels are disposed on individual respective axles.

* * * * *